US006294763B1

(12) United States Patent
Aono et al.

(10) Patent No.: US 6,294,763 B1
(45) Date of Patent: Sep. 25, 2001

(54) APPARATUS FOR ANNEALING WELDED PARTS AND METHOD THEREFOR

(75) Inventors: Kazuhiro Aono; Kazuyoshi Sakano; Hiroyuki Kageyama; Seiichi Gyotoku, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/460,431

(22) Filed: Dec. 14, 1999

(30) Foreign Application Priority Data

Dec. 15, 1998 (JP) ..... 10-355719

(51) Int. Cl.[7] ..... F27B 9/02; F27B 9/38; F27B 9/10

(52) U.S. Cl. ..... 219/400; 219/388; 219/411; 432/126

(58) Field of Search ..... 219/388, 400, 219/411; 126/21 A, 99 R, 10 A; 165/104.28, 104.31, 104.34; 392/375; 432/10, 11, 125, 126, 128; 198/465.1, 465.3, 468.1, 580

(56) References Cited

U.S. PATENT DOCUMENTS

| | | | | |
|---|---|---|---|---|
| 4,719,332 | * | 1/1988 | Markuson, Jr. | 219/388 |
| 5,030,809 | * | 7/1991 | Buday | 219/388 |
| 5,155,335 | * | 10/1992 | Habaki et al. | 219/388 |
| 5,158,224 | * | 10/1992 | Baker et al. | 219/388 |
| 5,242,096 | * | 9/1993 | Tsunabuchi et al. | 228/9 |
| 5,259,999 | | 11/1993 | Iwakiri et al. . | |
| 5,568,802 | * | 10/1996 | Buday et al. | 126/21 A |
| 5,573,688 | * | 11/1996 | Chanasyk et al. | 219/388 |
| 5,922,230 | * | 7/1999 | Yokota | 219/388 |

FOREIGN PATENT DOCUMENTS

| | | | |
|---|---|---|---|
| 04 22607 | | 4/1991 | (EP) . |
| 10 22341 | | 3/1966 | (GB) . |
| 58-133315 | * | 8/1983 | (JP) . |

OTHER PUBLICATIONS

Nishihara et al, abstract for JP11–172026A, Jun. 1999.*

* cited by examiner

*Primary Examiner*—Joseph Pelham
(74) *Attorney, Agent, or Firm*—Sughrue, Mion, Zinn, Macpeak & Seas, PLLC

(57) ABSTRACT

To prevent the temperature from rising locally in a closed space so as to make the temperature in an annealing furnace uniform, an apparatus and method for annealing welded parts includes an annealing furnace 2 which is substantially closed; a doorway 5 through which welded parts 4 are placed into and out of the annealing furnace; a carriage mechanism 6 for carrying welded parts on a predetermined course in the annealing furnace; infrared lamps 9 for heating welded parts carried in the annealing furnace; and a circulating mechanism 12 for circulating hot air in the annealing furnace. Thus, the annealing (distortion-eliminating) efficiency of the welded parts is improved.

10 Claims, 2 Drawing Sheets

APPARATUS FOR ANNEALING WELDED PARTS AND METHOD THEREFOR

The present invention relates to an annealing apparatus and an annealing method, particularly with respect to a technique for preventing the temperature from rising locally in a closed space so as to make the temperature in an annealing furnace uniform, and thus, improve the annealing (distortion-eliminating) efficiency.

BACKGROUND OF THE INVENTION

Stress remains inside synthetic resin parts welded by a welding mechanism such as a hot plate welding method, a vibration welding method, or the like, due to heat applied to the synthetic resin parts at the time of welding. It is therefore, necessary to keep the synthetic resin parts at a predetermined temperature for a time not shorter than a predetermined time, to thereby eliminate the residual stress.

Thus, there exists a prior art technique in which welded parts are carried on a predetermined course in a substantially closed annealing furnace while being heated at a predetermined temperature for a predetermined time in order to eliminate residual stress.

For example, a prior art steam annealing furnace for annealing welded parts with hot air is known. However, the problem with this prior art device is that the heating efficiency was insufficient, so that it took too much time to anneal.

Thus, an annealing furnace using infrared lamps having a superior efficiency of heating is used in the prior art. FIG. 2 is a schematically plan view showing the outline of such an annealing furnace a. Welded parts b, b, . . . are introduced into the annealing furnace a through a doorway c, and mounted on trays d, d, . . . , respectively, and moved in the direction of the arrow by a not-shown carriage means. While the welded parts mounted on the trays d, d, . . . make a round in the annealing furnace a, the welded parts are heated by not-shown infrared lamps, kept at a predetermined temperature for a time not shorter than a predetermined time to be annealed, and then extracted from the doorway c.

However, in the above-mentioned prior art annealing apparatus, there was a problem that welded parts b close to the infrared lamp rose too high in temperature to thermally deform when the doorway c was left closed for a long time for some reasons, for example, because a worker left his/her position.

In addition, in the above-mentioned annealing apparatus, there was a problem that a large plane space was required for installation of the annealing furnace a because the trays d, d, . . . moved in plane in the annealing furnace a.

Taking the foregoing circumstances into consideration, it is therefore an object of the present invention to prevent a temperature from rising locally in a closed space so as to make the temperature in an annealing furnace uniform, to thereby improve the annealing efficiency.

SUMMARY OF THE INVENTION

In order to achieve the above object, the apparatus for annealing welded parts of the present invention includes: an annealing furnace which is substantially closed; a doorway through which welded parts are placed into and out of the annealing furnace; a carriage means for carrying welded parts on a predetermined course in the annealing furnace; infrared lamps for heating welded parts carried in the annealing furnace; and a circulating mechanism for circulating hot air in the annealing furnace.

Accordingly, in the apparatus for annealing welded parts according to the present invention, circulation in the annealing furnace is performed by the circulating mechanism, so that there is no fear that the temperature rises only locally in the annealing furnace. It is therefore, possible to make the temperature in the annealing furnace uniform, so as to prevent welded parts from a thermal deformation caused by an unexpected temperature rise in the annealing furnace.

Further, there is provided an annealing method wherein welded parts are carried from an inlet to an outlet in a substantially closed space while the welded parts are heated by infrared rays so that the welded parts are kept at a predetermined temperature for a time not shorter than a predetermined time, while hot air in the closed space is circulated.

Accordingly, in the method for annealing welded parts according to the present invention, hot air in the closed space is circulated so that there is no fear that the temperature rises only locally in the closed space. It is therefore, possible to make the temperature in the annealing furnace uniform, so as to prevent welded parts from a thermal deformation caused by an unexpected temperature rise in the closed space.

DETAILED DESCRIPTION OF THE PREFERRED EMBODIMENTS

An embodiment of an annealing apparatus and an annealing method according to the present invention will be described below with reference to the accompanying drawings. In the embodiment shown in the accompanying drawings, the present invention is applied to an apparatus and a method for annealing synthetic resin parts in a car lamp.

Figure 1:
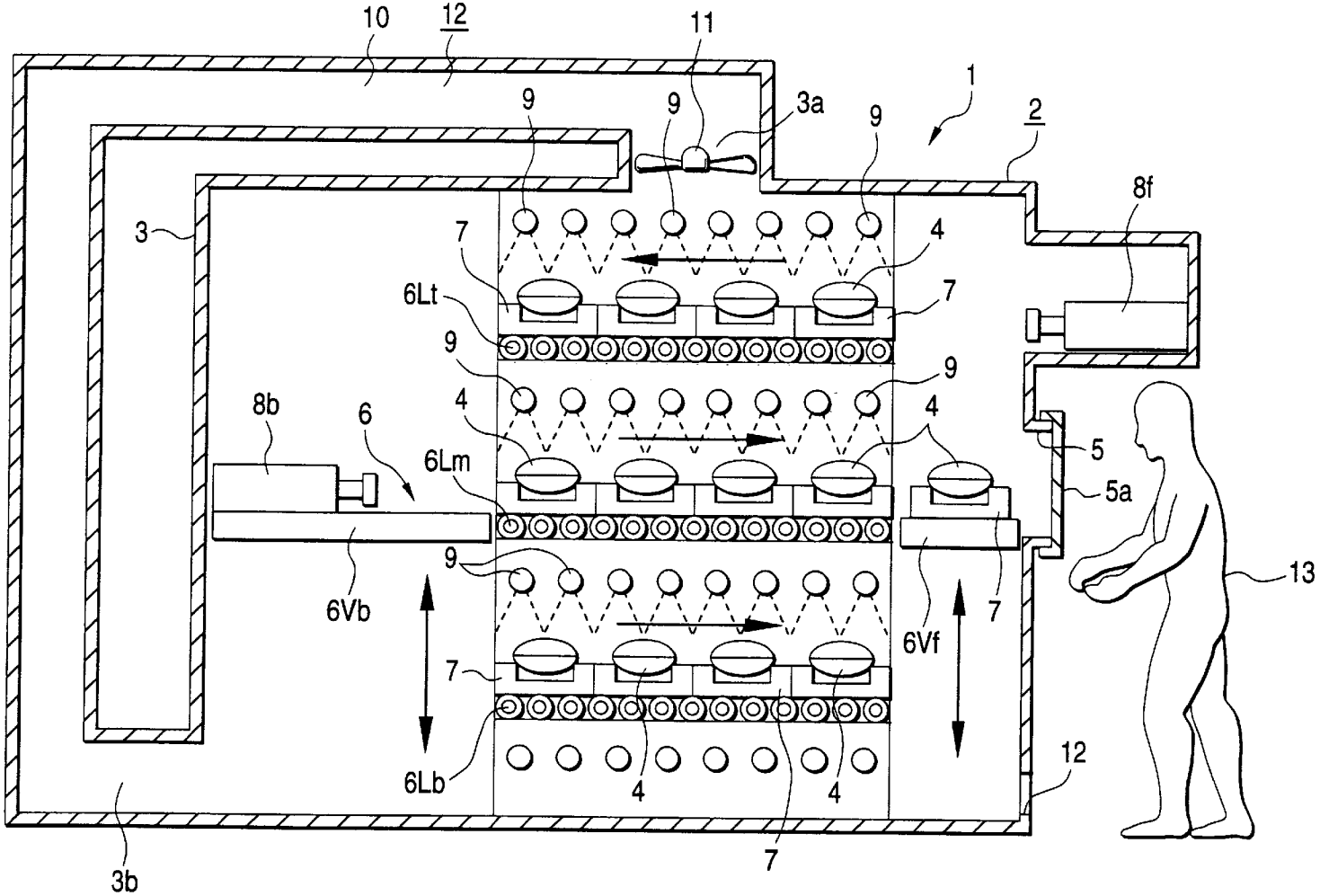
FIG. 1 shows a schematically longitudinally sectional view of an embodiment of an apparatus for annealing welded parts according to the present invention.
Figure 2:
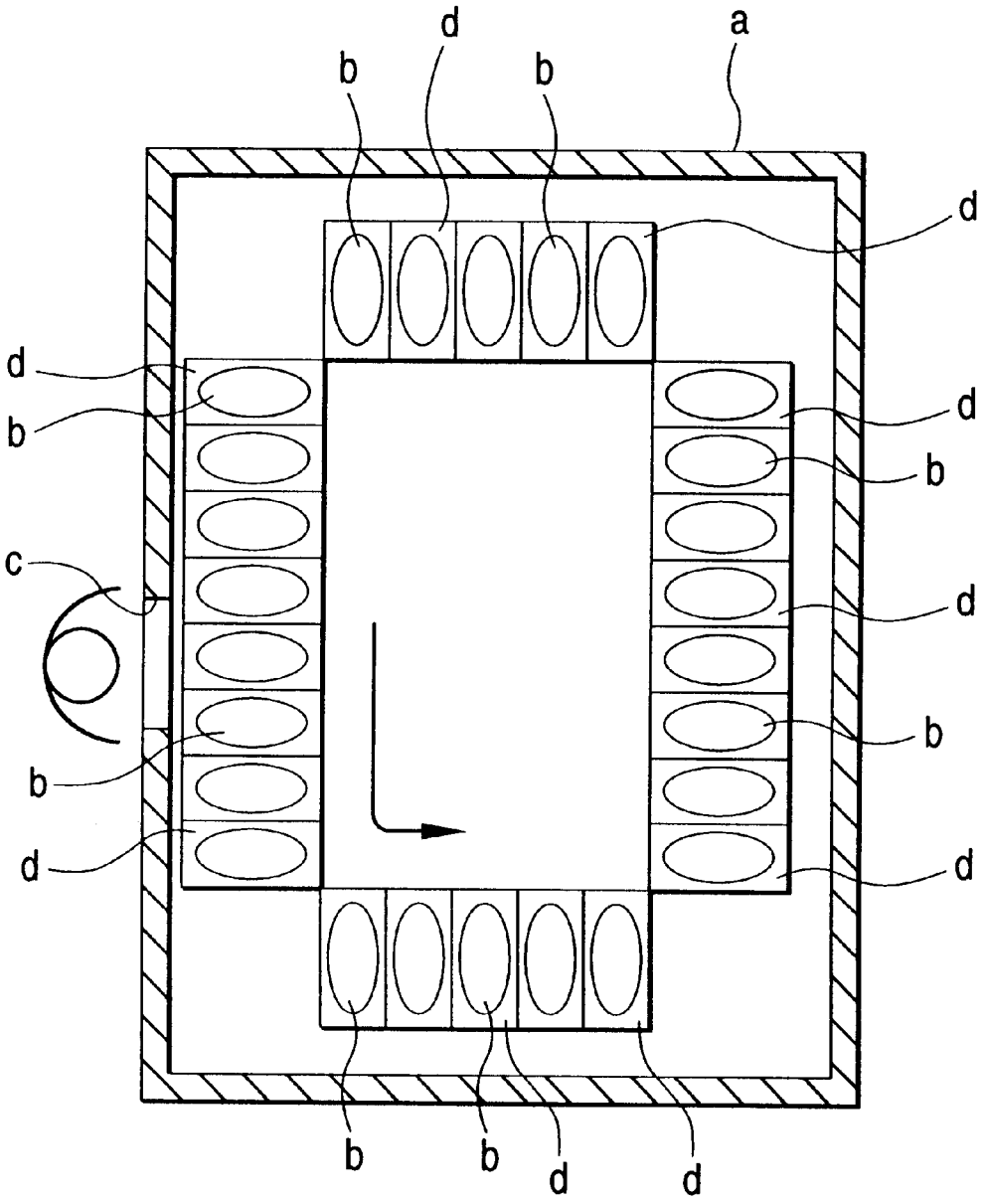
FIG. 2 PRIOR ART
FIG. 2 shows a schematically plan view of an example of an apparatus for annealing welded parts, according to the prior art.

An annealing apparatus 1 has an annealing furnace 2 (see FIG. 1). An outer shell portion 3 of the annealing furnace 2 is formed of an iron plate laminated with a not-shown heat insulating material so that the heat inside the annealing furnace 2 is not conducted to the outside. A doorway 5 through which welded parts (for example, welded parts of a lamp body and a lens) 4 are placed in/out of the furnace 2 is formed in one side of the outer shell 3. The doorway 5 can be opened and closed by a door 5*a*.

A carriage means 6, such as a conveyor belt or conveying rollers, for carrying the welded parts 4, 4, . . . on a predetermined course, is disposed in the annealing furnace 2. The carriage means 6 has horizontal carriage means 6L*b*, 6L*m*, and 6L*t*, such as a conveyor belt or conveying rollers, for carrying the welded parts 4, 4, . . . horizontally, and vertical carriage means 6V*b* and 6V*f*, such as a lift or elevator mechanism, for carrying the welded parts 4, 4, . . . vertically.

Each of the vertical carriage means 6V*b*, 6V*f*, is an elevator elevated by a not-shown elevating mechanism. Two vertical carriage means 6V*f* and 6V*b* are each disposed on the front side which is on the doorway 5 side, and on the back side which is on the opposite side to the doorway 5, respectively. Each horizontal carriage means 6L*b*, 6L*m*, 6L*t*, includes a roller conveyor extending from the front side to the back side of the furnace 2. The three horizontal carriage means 6L*b*, 6L*m*, and 6L*t*, are disposed vertically in three stages of a top stage, a middle stage and a bottom stage, respectively.

A plurality of trays 7, 7, . . . are mounted on each of the horizontal carriage means 6L*t*, 6L*m*, and 6L*b*, so as to be disposed in the carrying direction thereof. On the other hand, only one tray 7 is mounted on each of the two vertical carriage means 6V*f* and 6V*b*. No tray 7 is mounted on the back-side vertical carriage means 6V*b* before the first one of the welded parts 4 is placed in the furnace 2.

In addition, a pushing-out cylinder 8*f* is disposed in a position opposite to the front end of the top-stage horizontal carriage means 6L*t*, and a pushing-out cylinder 8*b* is disposed on the back-side vertical carriage means 6v*b*.

A large number of infrared lamps 9, 9, . . . are disposed above the respective horizontal carriage means 6L*t*, 6L*m*, and 6L.

When a substantially upper-end central portion 3*a* and a lower portion 3*b* of the outer shell portion 3 of the anneal furnace 2 are connected through a duct 10, a circulating fan 11 is disposed in the upper portion 3*a* which is a connection port of the duct 10 with the annealing furnace 2, so that a circulating mechanism 12 is formed. Circulation of the air in the duct 10 by means of the circulating fan 11 may be performed either from the upper portion 3*a* to the lower portion 3*b*, or from the lower portion 3*b* to the upper portion 3*a*.

Thus, the welded parts 4 are annealed according to the operation as follows.

The welded parts 4 are mounted by a worker 13 onto the tray 7 on the vertical carriage means 6V*f*, in the condition that the vertical carriage means 6V*f* is located in the position corresponding to the doorway 5 (it is also the position corresponding to the middle-stage horizontal carriage means 6L*m*).

When the door 5*a* of the doorway 5 is closed, the vertical carriage means 6V*f* moves up to a position corresponding to the top-stage horizontal carriage means 6L*t*. Then, since the back-side vertical carriage means 6V*b* and the front-side vertical carriage means 6V*f* are configured to move up/down synchronously, the back-side vertical carriage means 6V*b* is located in a position corresponding to the back-side end of the top-stage horizontal carriage means 6L*t* when the front-side vertical carriage means 6V*f* comes to a position corresponding to the front-side end of the top-stage horizontal carriage means 6L*t*.

At that time, the pushing-out cylinder 8*f* operates to push out the tray 7 mounted on the front-side vertical carriage means 6V*f* toward the horizontal carriage means 6L*t*. Then, the tray 7 on the front-side vertical carriage means 6V*f* moves to the front-side end of the horizontal carriage means 6L*t*, while the tray 7 mounted on the back-side end of the horizontal carriage means 6L*t* is pushed out by the movement by the other trays 7, 7, . . . on the horizontal carriage means 6L*t*, so that the tray 7 on the back-side end of the horizontal carriage means 6L*t* moves onto the back-side vertical carriage means 6V*b*.

Next, the vertical carriage means 6V*f* and 6V*b* move down to middle-stage positions corresponding to the level of the middle-stage horizontal carriage means 6L*m*. Then, the back-side pushing-out cylinder 8*b* operates to push-out the tray 7 mounted on the back-side vertical carriage means 6V*b* to the back-side end of the middle-stage horizontal carriage means 6L*m*. As a result, the tray 7 mounted on the back-side vertical carriage means 6V*b* moves onto the back-side end of the middle-stage horizontal carriage means 6L*m*, while the tray 7 mounted on the front-side end of the horizontal carriage means 6L*m* is pushed out by other trays 7, 7, . . . on the horizontal carriage means 6L*m* forward, so as to move onto the front-side vertical carriage means 6V*f*.

Then, the worker 13 opens the door 5*a*, extracts the annealed welded parts 4 mounted on the tray 7 on the front-side vertical carriage means 6V*f*, puts new welded parts 4 on the tray 7 on the vertical carriage means 6V*f*, and closes the door 5*a*.

Then, the vertical carriage means 6V*f* and 6V*b* move up to positions corresponding to the top-stage horizontal carriage means 6L*t*. Then, in the same manner as mentioned above, the tray 7 on the front-side vertical carriage means 6V*f* moves onto the horizontal carriage means 6L*t* while the tray 7 mounted on the back-side end of the horizontal carriage means 6L*t* moves onto the back-side vertical carriage means 6V*b*.

Next, the vertical carriage means 6V*f* and 6V*b* move down to positions corresponding to the bottom-stage horizontal carriage means 6L*b*. Then, the back-side pushing-out cylinder 8*b* operates to push-out the tray 7 mounted on the back-side vertical carriage means 6V*b* toward the back-side end of the bottom-stage horizontal carriage means 6L*b*. As a result, the tray 7 mounted on the back-side vertical carriage means 6V*b* moves onto the back-side end of the bottom-stage horizontal carriage means 6L*b* while the tray 7 mounted on the front-side end of the horizontal carriage means 6L*b* is pushed out by other trays 7, 7, . . . on the horizontal carriage means 6L*b* so as to move forward onto the front-side vertical carriage means 6V*f*.

Then, the vertical carriage means 6V*f* and 6V*b* move up to middle-stage positions. Thus, the worker 13 opens the door 5*a*, extracts the annealed welded parts 4 mounted on the tray 7 on the front-side vertical carriage means 6V*f*, puts new welded parts 4 onto the tray 7 on the vertical carriage means 6V*f*, and closes the door 5*a*.

Then, the vertical carriage means 6V*f* and 6V*b* move up to top-stage positions.

In the above-mentioned manner, the welded parts 4 are annealed while being carried alternately on the course of: the doorway 5*a*→the top-stage horizontal carriage means 6L*t*→the middle-stage horizontal carriage means 6L*m*→the doorway 5*a* and on the course of the doorway 5*a*→the top-stage horizontal carriage means 6L*t*→the bottom-stage horizontal carriage means 6L*b*→the doorway 5*a*; in the order of being thrown into the annealing furnace 2.

The hot air in the annealing furnace 2 is circulated by the circulating mechanism 12 so that the temperature in the annealing furnace 2 is averaged.

That is, when the circulating fan 11 of the circulating mechanism 12 rotates, the air circulates in the annealing furnace 2 and the duct 10, so that the temperature in the annealing furnace 2 is made uniform.

In addition, the temperature in the annealing furnace 2 is monitored by a not-shown temperature sensor. The sensor turns the infrared lamps 9, 9, . . . off when the temperature in the annealing furnace 2 rises too high, and the sensor turns the infrared lamps 9, 9, . . . on when the temperature in the annealing furnace 2 drops too low.

If an air outlet and an air inlet are provided in the annealing furnace 2 and the above-mentioned sensor controls opening/closing of the outlet and inlet, the temperature in the annealing furnace 2 can be made more uniform.

In the above-mentioned annealing apparatus 1, the air in the annealing furnace 2 is circulated by the circulating mechanism 12 so that there is no fear that the temperature rises only locally in the closed space. Accordingly, it is possible to make the temperature in the annealing furnace 2 uniform, so that the welded parts 4, 4, . . . are prevented from thermal deformation caused by an unexpected temperature rise in the closed space. Therefore, the failure ratio of annealing can be reduced.

In addition, the carriage course of the welded parts 4 is arranged vertically, so that it is possible to save space for installation of the annealing apparatus 1.

The shape and structure of each part shown in the above-mentioned embodiment merely show a specific example for carrying out the present invention. The technical scope of the present invention should not be interpreted in a limited fashion by these shapes and structures.

As will be clearly understood from the above description, according to the present invention, the apparatus for annealing welded parts includes: an annealing furnace which is substantially closed; a doorway through which welded parts are placed into and out of the annealing furnace; a carriage means for carrying welded parts on a predetermined course in the annealing furnace; infrared lamps for heating welded parts carried in the annealing furnace; and a circulating mechanism for circulating hot air in the annealing furnace.

Accordingly, in the apparatus for annealing welded parts according to the present invention, circulation in the annealing furnace is performed by the circulating mechanism, so that there is no fear that the temperature rises only locally in the annealing furnace. It is therefore, possible to make the temperature in the annealing furnace uniform, so as to avoid welded parts from a thermal deformation caused by an unexpected temperature rise in the annealing furnace.

In the present invention, the circulating mechanism, in addition to the circulating fan, includes a duct connecting upper and lower portions of the annealing furnace to each other. Accordingly, it is possible to make the temperature in the annealing furnace uniform, efficiently.

Further, in the present invention, the carriage course of the welded parts is arranged vertically, so that it is possible to save space for installation of the annealing apparatus 1.

Further, according to the present invention, there is rovided an annealing method wherein welded parts are carried from an inlet to an outlet in a substantially closed space while the welded parts are heated by infrared rays so that the welded parts are kept at a predetermined temperature for a time not shorter than a predetermined length of time, while hot air in the closed space is circulated.

Accordingly, in the method for annealing welded parts according to the present invention, hot air in the closed space is circulated so that there is no fear that the temperature rises only locally in the closed space. It is therefore, possible to make the temperature in the annealing furnace uniform, so that it is possible to prevent welded parts from a thermal deformation caused by an unexpected temperature rise in the closed space.

What is claimed is:

1. An apparatus for annealing welded parts, comprising:

an annealing furnace which is substantially closed, said annealing furnace having upper and lower portions;

a doorway through which welded parts are placed into and out of said annealing furnace;

a carriage carrying welded parts on a predetermined course in said annealing furnace;

a plurality of infrared lamps for heating welded parts carried in said annealing furnace; and a circulator circulating hot air in said annealing furnace, said circulator including a duct connecting said upper and lower portions of said annealing furnace to each other.

2. An annealing apparatus according to claim 1, wherein said circulator further comprises a circulating fan.

3. An apparatus for annealing welded parts, comprising:

an annealing furnace which is substantially closed, a doorway through which welded parts are placed into and out of said annealing furnace;

a carriage carrying welded parts on a predetermined course in said annealing furnace;

a plurality of infrared lamps for heating welded parts carried in said annealing furnace; and a circulator circulating hot air in said annealing furnace; wherein said carriage comprises:

a plurality of horizontal carriages arranged vertically, each of said plurality of horizontal carriages carrying welded parts horizontally; and a plurality of vertical carriages carrying welded parts between said plurality of horizontal carriages.

4. An annealing apparatus according to claim 3, wherein said plurality of vertical carriages each comprises an elevating mechanism and a push-out cylinder, and said plurality of vertical carriages move synchronously.

5. An annealing apparatus according to claim 1, wherein said carriage comprises:

a plurality of horizontal carriages arranged vertically, each of said plurality of horizontal carriages carrying welded parts horizontally; and a plurality of vertical carriages carrying welded parts between said plurality of horizontal carriages.

6. An annealing apparatus according to claim 5, wherein said plurality of vertical carriages each comprises an elevating mechanism and a push-out cylinder, and said plurality of vertical carriages move synchronously.

7. An annealing method for annealing welded parts, said annealing method comprising the steps of:

carrying welded parts from an inlet to an outlet in a substantially closed annealing furnace having upper and lower portions;

heating said welded parts by infrared rays during at least part of said carrying step, such that said welded parts are kept at a predetermined temperature for a time not shorter than a predetermined time, while hot air in said closed annealing furnace is circulated;

placing said welded parts on a first tray at a position corresponding to a doorway of the annealing furnace and a first horizontal carriage;

moving a first vertical carriage and a second vertical carriage synchronously to a position corresponding to a second horizontal carriage;

pushing out said first tray from said first vertical carriage to said second horizontal carriage while pushing out a second tray from said second horizontal carriage to a second vertical carriage;

moving said first vertical carriage and said second vertical carriage synchronously to a third horizontal carriage;

pushing out said second tray from said second vertical carriage to said third horizontal carriage while pushing out a third tray from said third horizontal carriage to said first vertical carriage;

moving said first vertical carriage synchronously with said second vertical carriage, to a position corresponding to said first horizontal carriage and said doorway; and removing said third tray through said doorway.

8. The annealing method according to claim 7, further comprising the step of heating said welded parts on said first, second, and third horizontal carriages, using infrared rays, such that said welded parts are kept at a predetermined temperature for a time not shorter than a predetermined time.

9. The annealing method according to claim 8, further comprising the step of circulating said hot air within said annealing furnace using a circulator.

10. An annealing method for annealing welded parts, said annealing method comprising the steps of:

carrying welded parts from an inlet to an outlet in a substantially closed space, said carrying step comprising, placing said welded parts on a first tray at a position corresponding to a doorway of an annealing furnace, moving a first vertical carriage and a second vertical carriage synchronously to a position corresponding to a first horizontal carriage, pushing out said first tray from said first vertical carriage to said first horizontal carriage while pushing out a second tray from said first horizontal carriage to a second vertical carriage, moving said first vertical carriage and said second vertical carriage synchronously to a second horizontal carriage, pushing out said second tray from said second vertical carriage to said second horizontal carriage while pushing out a third tray from said second horizontal carriage to said first vertical carriage, moving said first vertical carriage synchronously with said second vertical carriage, to said position corresponding to said doorway, and removing said welded parts placed on said third tray through said doorway; and heating said welded parts by infrared rays during at least part of said carrying step, such that said welded parts are kept at a predetermined temperature for a time not shorter than a predetermined time, while hot air in said closed space is circulated.

* * * * *